US012789960B1

(12) United States Patent
Davis

(10) Patent No.: US 12,789,960 B1
(45) Date of Patent: Nov. 10, 2026

(54) KAYAK STORAGE TREE

(71) Applicant: Jeffrey Davis, Crown Point, IN (US)

(72) Inventor: Jeffrey Davis, Crown Point, IN (US)

( * ) Notice: Subject to any disclaimer, the term of this patent is extended or adjusted under 35 U.S.C. 154(b) by 28 days.

(21) Appl. No.: 19/098,496

(22) Filed: Apr. 2, 2025

(51) Int. Cl.
*B63C 15/00* (2006.01)

(52) U.S. Cl.
CPC ..... *B63C 15/00* (2013.01)

(58) Field of Classification Search
CPC .. B63C 15/00; B62H 3/02; B62H 3/12; B63B 32/83; A47B 81/00; A47B 43/006
See application file for complete search history.

(56) References Cited

U.S. PATENT DOCUMENTS

| | | | | |
|---|---|---|---|---|
| 1,011,178 | A | 12/1911 | Farrah | |
| 3,872,972 | A * | 3/1975 | Cummins | B62H 3/12 211/117 |
| 3,924,751 | A | 12/1975 | Ballenger | |
| 5,014,955 | A * | 5/1991 | Thompson | B63B 32/83 441/74 |
| 6,056,274 | A | 5/2000 | Naas et al. | |
| 6,390,309 | B1 * | 5/2002 | Tucker | B63B 32/83 D6/552 |
| 7,150,449 | B1 | 12/2006 | Dueck et al. | |
| 7,367,547 | B2 | 5/2008 | Plzak | |
| 7,631,854 | B1 * | 12/2009 | Mountain | B62H 3/12 254/390 |
| 7,896,175 | B1 | 3/2011 | Corr et al. | |
| 8,033,529 | B2 | 10/2011 | Boda et al. | |
| 9,004,295 | B2 | 4/2015 | Dovner | |
| 9,669,907 | B2 | 6/2017 | Field | |
| 10,046,711 | B2 | 8/2018 | Zimmer | |
| 10,822,214 | B2 | 11/2020 | Gordon | |
| 10,946,805 | B2 * | 3/2021 | Skoff | B60R 9/06 |
| 11,572,022 | B2 | 2/2023 | Owen | |
| 11,654,989 | B2 | 5/2023 | Hall et al. | |
| 12,030,574 | B2 * | 7/2024 | Tanner | B62H 5/00 |

(Continued)

FOREIGN PATENT DOCUMENTS

| | | | | |
|---|---|---|---|---|
| CN | 107310659 A | * | 11/2017 | B62H 3/12 |
| CN | 107738707 A | * | 2/2018 | B62H 3/12 |
| CN | 109677514 A | * | 4/2019 | B62H 3/12 |

OTHER PUBLICATIONS

Store Your Board, https://storeyourboard.com/products/triple-freestanding-sup-kayak-rack-vertical-storage-for-retail?variant=46010024526105&currency=USD&utm_medium=product_sync&utm_source=google&utm_content=sag_organic&srsltid=AfmBOoqks2EAq1K5VKTZavKbzo3yKMJ5THPKnF-1GF2DxqjaUT3WFXzv0kk, accessed on Apr. 2, 2025.

(Continued)

*Primary Examiner* — Patrick D Hawn
(74) *Attorney, Agent, or Firm* — Bold IP PLLC; Houda El-Jarrah

(57) ABSTRACT

A kayak storage tree. The kayak storage tree comprises a cover connected to a central pole, and a base plate attached to a lower end of the central pole. The base plate is firmly attached to a concrete pillar inserted into the ground. The kayak storage tree includes multiple pulleys attached to upper hooks in order to hoist the kayaks upward using the pulleys. Long cables or ropes are attached to the pulleys and a sturdy fastener is attached to a top end and a lower end of the cables or ropes in order to fasten the kayaks to the upper hooks and further there are bolts or other fasteners attached to the base plate. The kayaks are stored in a vertical upright position and held firmly to the kayak storage tree.

14 Claims, 6 Drawing Sheets

(56) References Cited

U.S. PATENT DOCUMENTS

| | | | | |
|---|---|---|---|---|
| 2003/0178382 | A1* | 9/2003 | Tucker | A47B 96/061 211/85.7 |
| 2022/0289350 | A1 | 9/2022 | Larkin | |

OTHER PUBLICATIONS

Autodesk Instructables, https://www.instructables.com/This-Is-a-Super-Easy-and-Super-Quick-Way-to-Vertic/, accessed on Apr. 2, 2025.

Teal Triangle Elite Kayak Pulley System, https://www.amazon.com/Teal-Triangle-Pulley-Ceiling-Paddleboards/dp/B0BFTH4LCR?ref_=ast_sto_dp, accessed on Apr. 2, 2025.

* cited by examiner

KAYAK STORAGE TREE

FIELD OF THE DISCLOSURE

The present invention relates to a kayak storage tree capable of storing at least one to four kayaks in a vertical, upright position so as to provide protection and coverage of the stored kayaks and to minimize any damage from unwanted elements affecting the kayaks while being stored on the kayak storage tree.

BACKGROUND

Kayaks are very heavy, hard to store, and take up a great deal of space. Many kayaks will range from 6-25 feet long depending on if the kayaks are recreational kayaks, touring kayaks, sea kayaks, or tandem kayaks.

Kayaks need storage but available storage options are extremely problematic. Typically, people will store them in their garage or a shed by letting them stay on the floor of the garage or shed, which takes up room and does not fully protect the interior or exterior of the kayak from issues with water, mold, or unwanted objects being placed over the kayaks. In other situations, kayaks are left for storage in an outside, uncovered area with a tarp or cover placed over the kayak, which also leaves the kayak exposed to water entering the interior of the kayak beneath the tarp and/or extra dirt, debris, and unwanted exposure to the outdoor elements. These existing options are very deficient. Accordingly, there is a need for an improved method and system of storing kayaks that reduces the difficulty in storing the kayaks and protects them while stored.

SUMMARY

The present description relates to an apparatus comprising a kayak storage tree for storing and holding one or more kayaks in an upright position when stored. The kayak storage tree may further comprise a cover for the central pole, wherein the central pole is attached to an underside of the cover. The kayak storage tree may further comprise a first hanging rod attached to a left side of the central pole, wherein the first hanging rod is attached to an upper portion of the central pole proximate to the underside of the cover, wherein a first pulley is attached to a terminal end of the first hanging rod, wherein a first cable is configured to be inserted into the first pulley. The kayak storage tree may further comprise a second hanging rod attached to a right side of the central pole, wherein the second hanging rod is attached to the upper portion of the central pole proximate to the underside of the cover, wherein a second pulley is attached to a terminal end of the second hanging rod, wherein a second cable is configured to be inserted into the second pulley. The kayak storage tree may further comprise a first hook piece attached to a front side of the central pole, wherein the first hook piece is generally perpendicular to the first hanging rod and the second hanging rod, wherein a third pulley is attached to the first hook piece, wherein a third cable is configured to be inserted into the third pulley. The kayak storage tree may further comprise a second hook piece attached to a rear side of the central pole, wherein the second hook piece is generally perpendicular to the first hanging rod and the second hanging rod, wherein a fourth pulley is attached to the second hook piece, wherein a fourth cable is configured to be inserted into the fourth pulley.

The kayak storage tree may further comprise a base plate, wherein the central pole is also attached to a base plate. The present description may further include that the base plate has a first anchor, a second anchor, a third anchor, and a fourth anchor, wherein the first anchor, the second anchor, the third anchor, and the fourth anchor are eye bolts.

The first anchor may be attached to a front side of the base plate and the second anchor is attached to a rear side of the base plate. The third anchor may be attached to a left side of the base plate and the fourth anchor is attached to a right side of the base plate.

In a non-limiting embodiment, a width of the cover is wider than a width of the base plate. The kayak storage tree may be configured to store between one to four kayaks. The apparatus of claim 1, wherein a kayak stored on the kayak storage tree is raised off of a ground level and stored in a vertical, upright position beneath the cover. In a non-limiting embodiment, a clip fastener is attached to a first end of the first cable and wherein a second clip fastener is attached to a second end of the first cable, wherein the first cable is inserted through the first pulley. In a non-limiting embodiment, a first clip fastener is attached to a first end of the second cable and wherein a second clip fastener is attached to a second end of the second cable, wherein the second cable is inserted through the second pulley.

In a non-limiting embodiment, a first clip fastener is attached to a first end of the third cable and wherein a second clip fastener is attached to a second end of the third cable, wherein the third cable is inserted through the third pulley. In a non-limiting embodiment, a first clip fastener is attached to a first end of the fourth cable and wherein a second clip fastener is attached to a second end of the fourth cable, wherein the fourth cable is inserted through the fourth pulley.

Other aspects and advantages of the invention will be apparent from the following description and the appended claims.

BRIEF DESCRIPTION OF THE DRA WINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

The present description includes exemplary embodiments for a unique kayak storage tree or stand that is unique in one or more non-limiting embodiments, in part, because the kayak storage tree can hold the kayaks in an upright position so that the lower end of the kayak is raised off of the ground. Additionally, the method of storage and kayak storage tree components, including a wide protective cover, help to minimize negatively affecting the structure and makeup of the kayaks with unwanted exposure to water, snow, dirt, debris or other elements. Further details are provided in reference to the accompanying Figures.

Figure 1:
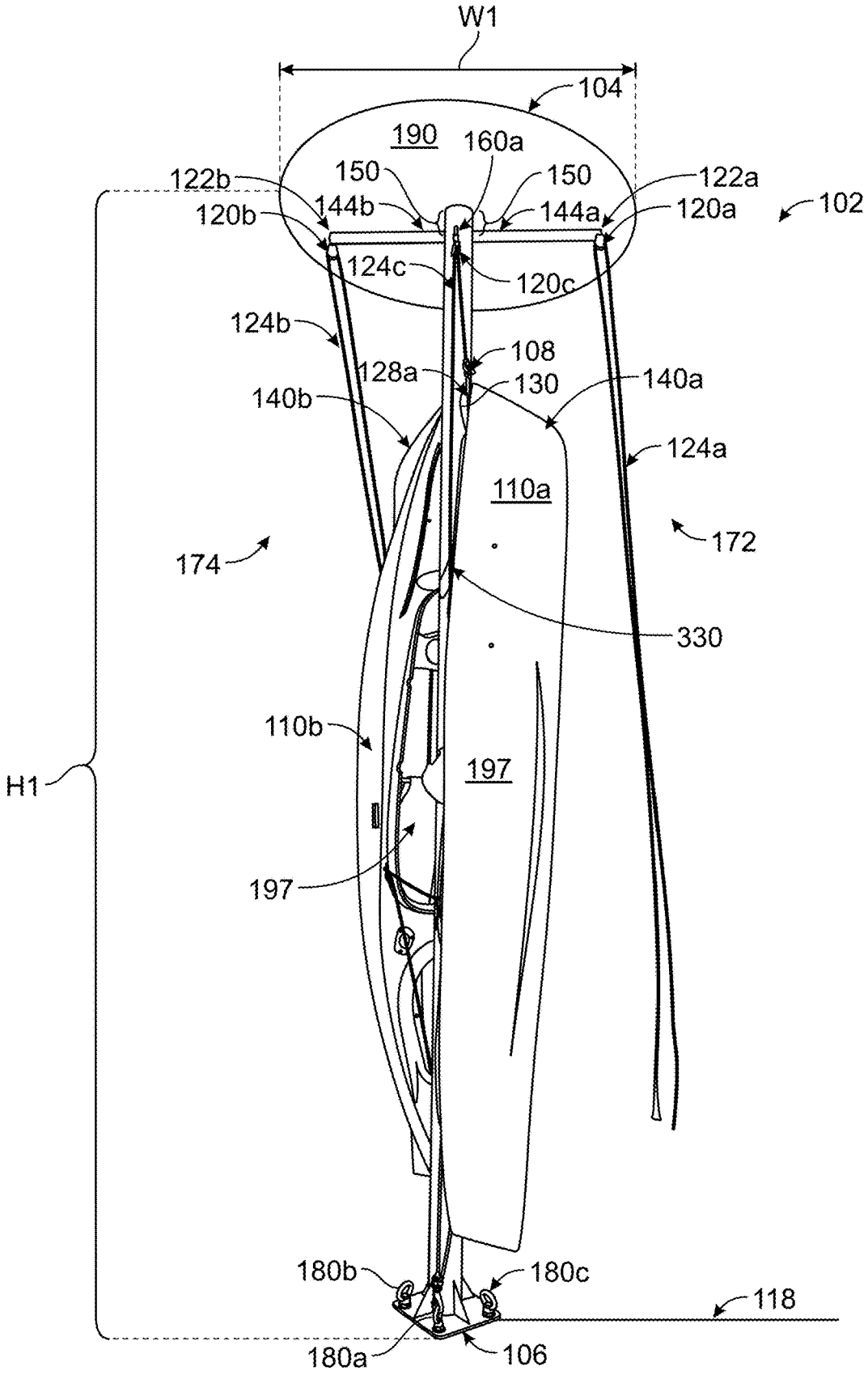
FIG. 1 is a pictorial illustration of a perspective view of a kayak storage tree.

FIG. 1 depicts an exemplary pictorial illustration of a kayak storage tree 102. The kayak storage tree 102 may comprise a top cover 104 which acts as an awning or roof to protect the stored kayaks 110. The kayak storage tree 102 further comprises a central pole 108 that is firmly attached to an underside 190 of the kayak storage tree 102. The kayak storage tree 102 further comprises a baseplate 106, wherein the central pole 108 is attached to both the top cover 104 and to the baseplate 106 of the kayak storage tree 102. The central pole 108 may be sufficiently elongated and may have a sufficiently wide enough diameter to be stable and to firmly support the kayak storage tree 102 including any kayaks 110 stored therein. The central pole 108 may be a single entity or multiple entities/pieces in one or more non-limiting embodiments. The central pole 108 spans the distance between the top cover 108 and the base plate 106. In a non-limiting embodiment, there is one central pole 108 centrally affixed to the top cover 104 in a center position and to the base plate 106 in a central position on the top surface 204 of the base plate 106. In alternative embodiments, there may be more than central pole 108 if needed for additional stability.

Figure 4:
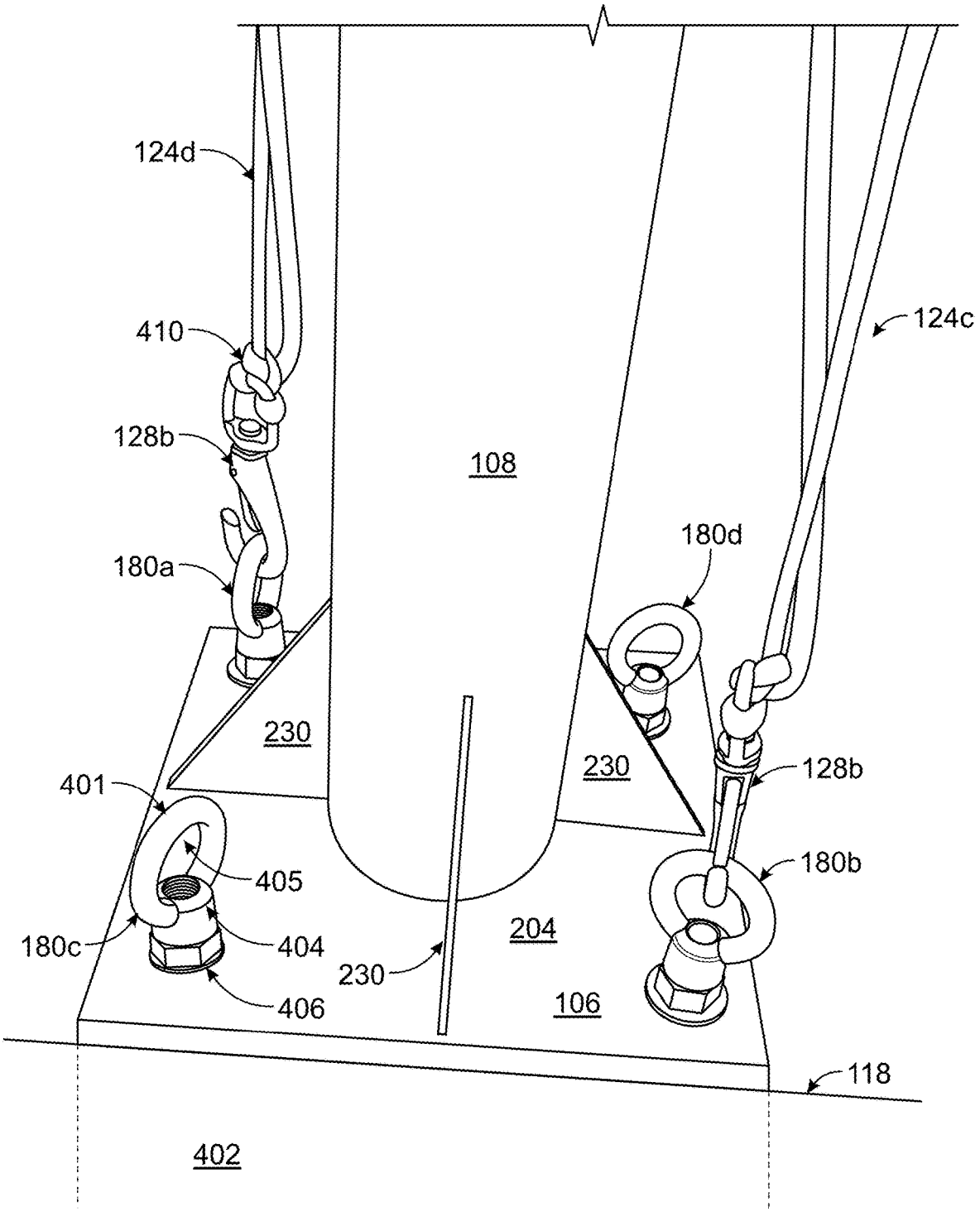
FIG. 4 is a pictorial illustration of the base plate of the kayak storage tree.

In a non-limiting embodiment, the base plate 106 of the kayak storage tree 102 is intended to be firmly fixed and anchored into the ground or other floor 118. The base plate 102 may need to be firmly cemented with cement or other fixation techniques into the ground/floor 118. The base plate 106 is preferably firmly fastened via bolts (e.g., bolts 406) and a threaded shank of an eye bolt 180 (e.g., as shown in FIG. 4) into the ground or other floor level 118. In a non-limiting embodiment, the base plate 106 is fastened into the ground or other floor 118 with multiple anchors, bolts, or other types of fasteners so as to ensure the base plate 106 does not move even while kayaks 110 are stored in an upright, vertical position (e.g., as shown in FIG. 1) on the kayak storage tree 102. The base plate 106 may further be anchored into a subsurface 402, such as that shown beneath the base plate 106 in FIG. 4. In a non-limiting embodiment, the subsurface 402 is a concrete slab or concrete pillar or other manufactured structure formed beneath the ground or floor level 118. It may be recommended that the user ensure that there is a concrete slab or buried column that the base plate 106 may be affixed to firmly hold the kayak storage tree 102 upright and in place. The subsurface 402 is preferably very solid and acts as a reliable surface to affix the base plate 106 to and to withstand the load of the kayak storage tree 102 and stored kayaks 110.

In a non-limiting embodiment, a height H1 of the kayak storage tree 102 is long enough to store multiple kayaks 110. Kayaks can range from 6 to 18 feet long, depending on the type of kayak and the intended use. Recreational kayaks are typically 9-13 ft long, and the most common length for recreational kayaks is 10 ft. Touring kayaks are typically 12-15 ft long. Sea kayaks may be 15-18 ft long and are also known as touring kayaks. Performance kayaks are typically 15-18 ft long and are built for speed. Whitewater kayaks are typically 7-11 ft long, and the width of the boat is less important than the paddler's height. The kayak storage tree 102 may be suited to accommodate any such kayaks 110. Accordingly, it may be preferable for the height H1 of the kayak storage tree 102 to be at least 11 feet long but may range up to 21-22 feet long as well. These dimensions are meant to be exemplary and non-limiting. The intention is to ensure that the height H1 of the kayak storage tree 102 may be sufficiently tall enough in its height to cover a variety of kayaks 110, although the kayak storage tree 102 may be manufactured to have varying widths and heights customized to suit certain types of kayaks 110 as well.

The width W1 of the cover 104 of the kayak storage tree 102 may be sufficiently wide enough to extend beyond the sides of the stored kayaks, such as stored kayaks 110*a* and 110*b* as shown in an exemplary embodiment in FIG. 1. The width W1 of the cover 104 of the kayak storage tree 102 is also wider than the width of the baseplate 106 in a non-limiting embodiment. In a non-limiting embodiment, the width W1 of the cover 104 of the kayak storage tree 102 may range from at least 4 feet to 7 feet wide although it may be wider or narrower in alternative embodiments.

Notably, the cover 104 is able to provide protection against rain, sun, snow, or any other outside elements in case the kayak storage tree 102 is installed in an outside location. The cover 104 is configured and designed to be wide enough to prevent these unwanted elements from entering into the interior 195 of the kayak 110. As shown in FIG. 1, one of the advantages of storing the kayaks 110 in a vertical, upright position, is that the interior portion 195 of the kayak 110 may be oriented towards the central pole 108, while the exterior 197 (e.g., including the sides and the hull of the kayak 110) may face outward and away from the central pole 108, thus enabling the interior 195 portion of the kayak 110 to remain dry and free of moisture from elements such as rain, snow, dirt, mud, or the like. The exterior 197 portion of each kayak 110 is also protected from unwanted elements by not being stored in a horizontal position on the ground level or floor level 118. By raising the kayaks 110 to be stored in a vertical, upright position under the cover 104 of the kayak storage tree 102, the kayaks 110 are able to be kept cleaner and free of elements that may damage the kayak 110.

Figure 5:
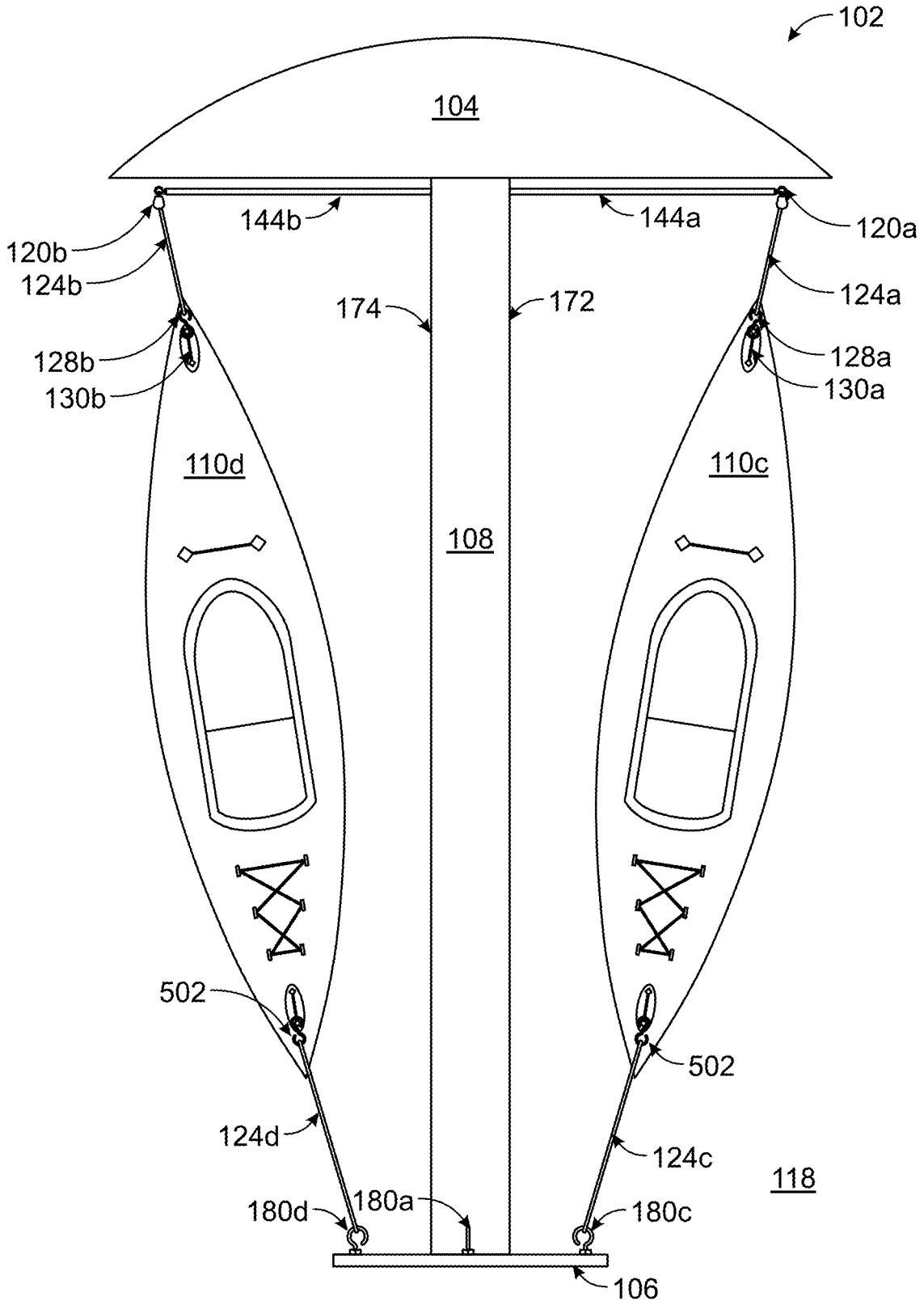
FIG. 5 is a pictorial illustration of kayaks hanging from and attached to parallel sides of the hanging rod of the kayak storage tree.

In addition to the above, the kayak storage tree 102 may comprise multiple components that further enable the kayak storage tree 102 to be used to hang and orient the kayaks 110 in a vertical, upright position for storage. In a non-limiting embodiment, it may be preferable that the kayak storage tree 102 is able to store at least four kayaks 110 in a vertical, upright position at the same time on the kayak storage tree 102 if a user so desires. FIG. 1 and FIG. 5 herein show two kayaks 110 stored at the same time on the kayak storage tree 102, but the design of the kayak storage tree 102 as shown herein is able to accommodate between one to four kayaks 110 being stored at the same time.

In a non-limiting embodiment, there may be a first hanging rod 144*a* firmly attached to a left side 172 of the central pole 108 and a second hanging rod 144*b* that is firmly attached to a right side 174 of the central pole 108. Multiple pulleys, such as first pulley 120*a*, second pulley 120*b* (e.g. as shown in FIG. 1), third pulley 120*c*, fourth pulley 120*d* (e.g., as shown in FIG. 1-FIG. 5) are integrated into the kayak storage tree 102 for use in raising and lowering the kayaks 110. Cables or ropes, such as cables 124*a*, 124*b*, 124*c*, 124*d* are also threaded through each pulley (e.g., pulleys 120*a*, 120*b*, 120*c*, 120*d*) and connected at each end of the cables 124*a*, 124*b*, 124*c*, 124*d* with one or more high strength clips that allow clipping onto both the kayak 110 and to an anchor point or eye bolt (e.g. anchor or eye bolts 180*a*, 180*b*, 180*c*, 180*d* as shown in FIGS. 1-2 and FIGS. 4-5).

In a non-limiting embodiment, as shown in FIG. 1, a first pulley 120*a* is firmly attached or affixed to a terminal end 122*a* of the first hanging rod 144*a*. The second pulley 120*b* is attached or affixed to a terminal end 122*b* of the second hanging rod 122*b*. As shown in the exemplary embodiment of the kayak storage tree 102 in FIG. 1, the first pulley 120*a* and the second pulley 120*b* are not positioned very close or proximate to the central pole 108 so as to provide enough room to raise and lower the kayak 110.

In a non-limiting embodiment, the length of the first hanging rod 144*a* and the length of the second hanging rod 144*b* are equivalent and may be approximately between 8 inches-14 inches each in length to extend the first pulley 120*a* and second pulley 120*b* away from the central pole 108 and enable a kayak 110 to hang from each pulley 120*a*, 120*b* without bumping into the pole 108 or overcrowding.

In a non-limiting embodiment, the first hanging rod 144*a* is located a distance 150 (e.g. as shown in FIG. 1) below the underside 190 of the cover 108. Similarly, the second hanging rod 144*a* is located a distance 150 below the underside 190 of the cover 108.

There may also be a first hook piece 160*a* attached to the central pole 108 from the front side 330 side (e.g., as shown more clearly in FIG. 3) and a second hook piece 160*b* attached to the central pole 108 from the rear side 332. There may be a first extender piece 306*a* connected to the first hook piece 160*a* and a second extender piece 306*b* connected to the second hook piece 160*b*, as further shown in FIG. 3, to position the first hook piece 160*a* and the second hook piece 160*b* away from the side of the central pole 108 to enable the third and fourth pulleys 120*c*, 120*d*, respectively, that are attached to the first hook piece 160*a* and the second hook piece 160*b* to rotate and to enable the kayaks 110 to be stored on the first hook piece 160*a* and the second hook piece 160*b* without excessive contacting or bumping against the central pole 108.

Figure 3:
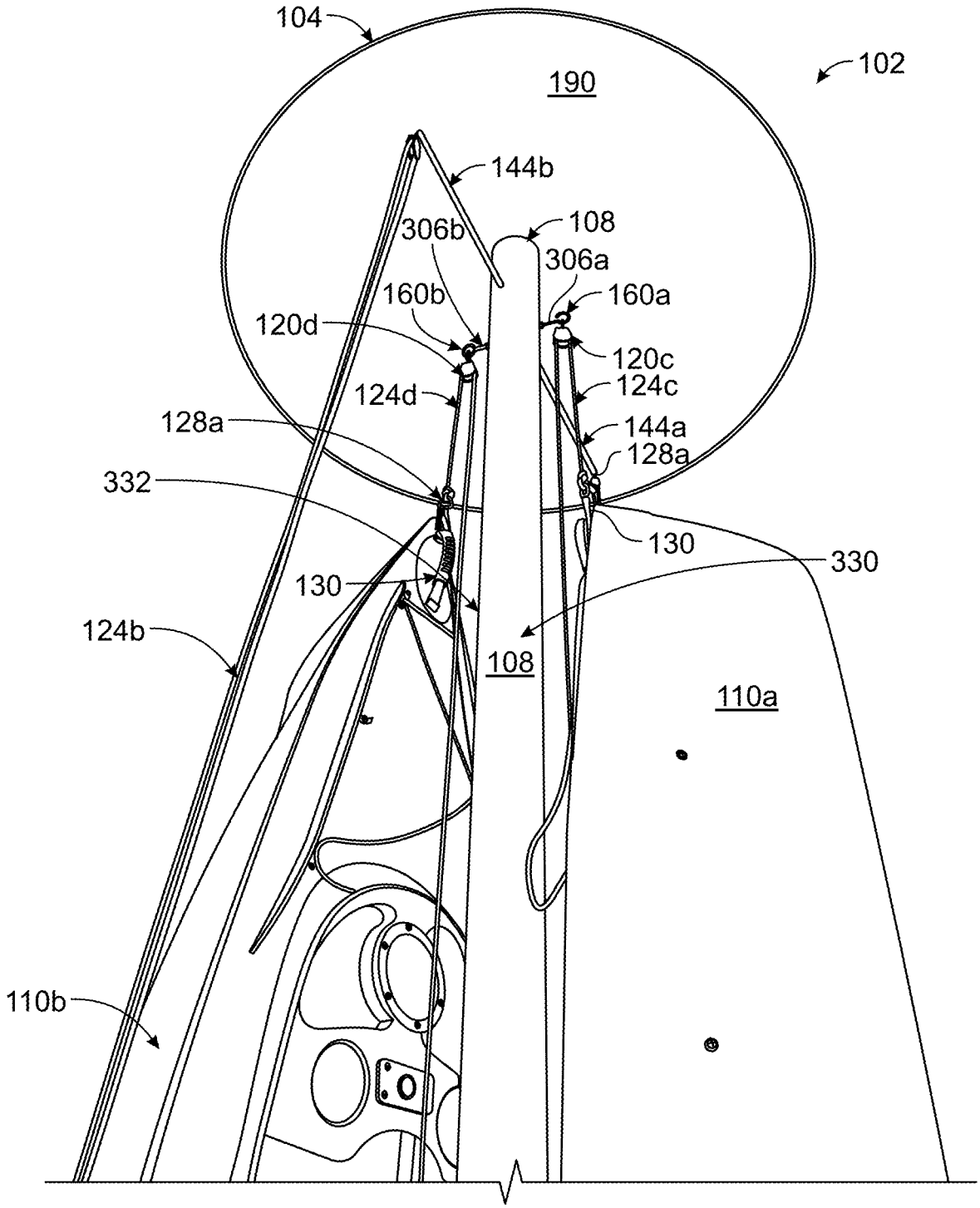
FIG. 3 is a pictorial illustration of an upper portion of the kayak storage tree shown in FIG. 1.

Accordingly, the first hanging rod 144*a* is aligned with the second hanging rod 144*b* in its attachment on the central pole 108 in a non-limiting embodiment as located on the left side 172 and the right side 174 of the pole 108 (e.g. as shown in FIG. 1). Further, the first hook piece 160*a*, and second hook piece 160*b* are aligned with each other as well as located on a front side 330 and the rear side 332 of the pole 108 (e.g. as shown in FIG. 3). FIG. 3 shows how the hanging rods 144*a*, 144*b* and the first and second hook pieces 160*a*, 160*b* are, respectively, perpendicular to each other and to the central pole 108. FIG. 3 shows that the pulley 120*c* is attached to the first hook piece 160*a*, and the pulley 120*d* is attached to the second hook piece 160*b*.

A cable 124*c* is threaded through the pulley 120*c* and a cable 124*d* may be threaded through the fourth pulley 120*d* (e.g. as shown in FIG. 3). Another cable 124*a* may be threaded through the pulley 120*a* and another cable 124*b* may be threaded through the pulley 120*b* as shown in FIG. 1. The cables 124*a*, 124*b*, 124*c*, 124*d* may be at least 20-40 feet long depending on the length of the kayaks 110 that need to be stored on kayak storage tree 110. The cables 124*a*, 124*b*, 124*c*, 124*d* may be made of high strength materials including but not limited to metal or reinforced wire, plastic, rope material, or any other type of material. The cables 124*a*, 124*b*, 124*c*, 124*d* are elongated ropes or cables that are cylindrically shaped.

At each end of each cable 124*a*, 124*b*, 124*c*, 124*d*, there may be a high strength clip/fastener such as clip 128*a* and 128*b* shown in FIG. 1. The top clip 128*a* may be used to attach each cable 124 to a handle such as handle 130 of a kayak 110*b*, as shown in FIG. 3. To hoist the kayak 110*b*, the user may begin pulling on the cable 124 once the top clip 128*a* has been attached to the handle 130 of the kayak 110*b*, whereby pulling on the cable 124 will cause the kayak 110*b* to move from a horizontal position slowly to a vertical upright position because the pulley (e.g., pulley 120*b* or any pulley shown herein) will rotate and allow the cable 124 to move along the pulley 120*b*. Once the kayak 110*b* is oriented from a horizontal position (e.g., as laid out near the kayak storage tree 102 on the ground level 118), to a fully vertical position as shown in FIGS. 1-5, then the user may secure the other end of the cable 124 which has a clip 128*b* attached to this bottom end of the cable 124, such that the user may clip the bottom clip 128*b* or otherwise attach a fastener to one of the anchors or eye bolts 180*a*, 180*b*, 180*c*, 180*d* as desired which are firmly affixed to the base plate 106. In this manner, the vertically oriented kayak 110*b* is clipped at the top end via top clip (e.g., top clip 128*a*) to a handle 130 (or other part of a kayak 110) and also clipped firmly to a lowermost anchor/eye bolt 180*a*, 180*b*, 180*c*, 180*d* located on the base plate 106 of the kayak storage tree 102. The handle 130 is a convenient and secure piece of the kayak 110 that is raised and has a gap to allow the clip 128*a* to clip onto the handle 130, but it is also noted that the top clip 128*a* may alternatively be clipped onto another part of the kayak 110 and is not restricted to only being clipped onto a handle, such as handle 130 of the kayak 110.

It is noted that as an alternative to the term "clip", a hook or other fastener type may be used in place of clips 128 as shown herein. The clips 128 or other types of fastener are secured onto each end of the cable 124 by firmly knotting each end of the cable 124 around a part of the clip 128 (e.g., part 410 as shown in FIG. 4). It is noted that the clip 128 may be any type of clip 128 as known in the art including heavy duty industrial clips.

Figure 2:
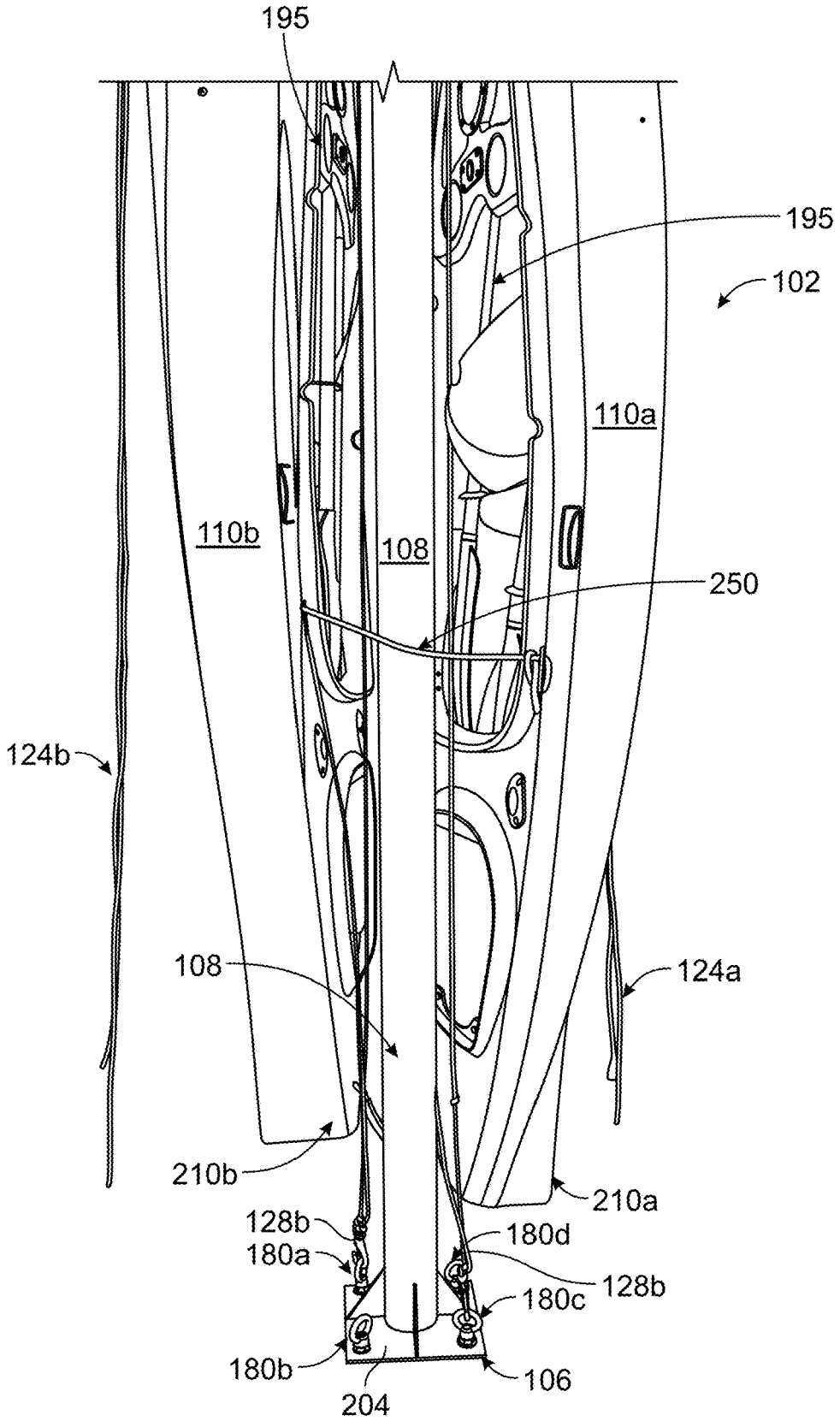
FIG. 2 is a pictorial illustration of kayaks attached to a base plate of the kayak storage tree shown in FIG. 1.

As shown in FIG. 2, the bottom end 210*a*, 210*b* of each stored kayak 110*a*, 110*b*, respectively, is raised off of the ground level 118 in order to intentionally keep the kayak 110*a*, 110*b* from touching the ground 118 to further protect the kayak 110 from any unwanted elements from dirtying or damaging the kayak 110 including but not limited to water, mud, snow, ice, etc. The kayak 110 may thus be stored and preserved in better condition by raising the kayak 110 off of the ground 118 in a vertical orientation.

Further, as shown in FIG. 1, the top end 140*a*, 140*b* of the stored vertically oriented kayaks 110*a*, 110*b* are not touching the top of the hanging rods 144*a*, 144*b*, but rather are stored a distance below the hanging rods 144*a*, 144*b* and/or the first hook piece 160*a* and second hook piece 160*b*. This may help to balance the distribution when storing the kayaks 110 in a vertical orientation between the upper components (e.g. hanging rods 144 and hook pieces 160) and the lower components on the base plate 106.

FIGS. 2 and 4 show that the base plate 106 may further include stabilizer type fins 230 on each side of the central pole 108 as attached to the top surface 204 of the base plate 106. The stabilizer fins 230 further aid to stabilize the weight on the base plate 106.

To further stabilize the kayaks 110 when held against the central pole 108 and the kayak storage tree 102, it may be useful for the user to run any extra portions or amount of cable 124 that is stemming or flowing down from each pulley 120 around a middle portion (e.g., near portion 250) of the kayaks 110 so as to further stabilize and tie down in place the kayaks 110 in their vertical, upright position on the kayak storage tree 102. In some cases, the interior 195 of the kayak 110 is facing the central pole 108 during storage as shown in FIGS. 1-3, which may further help to protect the interior 195 of the kayak 110 to stay dry and in some cases the interior 195 of the kayak 110 may be facing away from the central pole 108 (e.g., as shown in FIG. 5).

As shown in FIG. 4, the eye bolts 180 may each comprise an eye 401 (i.e., a rounded loop with central cavity 405 for receiving clip 128), and/or a shoulder 404 that is firmly bolted via bolt 406 into the base plate 106 and/or concrete or other firm subsurface 402 that the base plate 106 is affixed to. The eye bolt 180 are bolts with loops, such as loops or eyes 401, at its upper end, as shown in FIG. 4, that are used to secure the kayaks 110 with the ropes or cables 124. The eye bolts 180 further include a threaded shank (not shown) for each eye bolt 180 embedded into the bolt 406 and the base plate 106 deep enough into the subsurface 402 beneath the base plate 106.

FIG. 5 shows the example of the kayak storage tree 102 in which two kayaks, kayak 110*c* and 110*d*, are attached to the pulley 120*a* and second pulley 120*b*, respectively. The first pulley 120*a* and the second pulley 120*b* are attached to either terminal end of the first hanging rod 144*a* and the second hanging rod 144*b*. A cable 124 (e.g. cable 124*a* and cable 124*b*) is threaded or otherwise pre-configured to be included and pulled through the first pulley 120*a* and the second pulley 120*b* whereby the top end of the cables 124*a*, 124*b* is secured via clip 128*a*, 128*b* to each handle 130*a*, 130*b* of each kayak 110*c*, 110*d*. The kayaks 110*c*, 110*d* are configured to be pulled by the user manually or electrically raised from a horizontal to a vertical position and orientation as shown in FIG. 5. The lower end of the cables 124*a*, 124*b* is then secured to a specific eye bolt/anchor 180*c*, 180*d*, as shown for example in FIG. 5, that is firmly affixed to the base plate 106 (which is firmly fastened and/or affixed to the ground level 118). FIG. 5 shows a variation in which the cables 124 are not continuously thread through the pulleys 120*a*, 120*b* as a single entity or unit, but rather are broken up into separate units 124*a*, 124*b*, 124*c*, 124*d*. The smaller, separate pieces of cable 124*c*, 124*d* may be individually connected to each lower end 502 of each kayak 110*c*, 110*d* and then attached to an eye bolt 180 as desired. FIG. 5 further helps to illustrate that the user can choose whether to orient and store kayaks 110 on each lateral left and right side of the kayak storage tree 102 or facing the central pole 108 from the front side 330 and back/rear side 332 as shown in FIGS. 1-4 for example and in FIG. 3 in particular.

Advantageously, the design of the kayak storage tree 102 allows user to store their kayaks 110 vertically with less effort to install the kayaks 110 and hold the kayaks 110 in place on the kayak storage tree 102. By installing the kayak storage tree 102, users are able to store, in a non-limiting embodiment, multiple kayaks 110 in a much smaller area as the kayak storage tree 102 is designed to have a smaller profile or footprint.

In a non-limiting embodiment, the kayak storage tree 102 may include a motorized winch operated with an up/down switch that can raise and lower the kayaks 110 into position vertically and then the user can tie down or hook the kayaks 110 into place. Alternatively, the user may manually, through the user's strength and power, pull on the cables 124 incorporated with one or more pulleys 120 in order to raise and lower the kayaks 110.

An exemplary method of using the kayak storage tree 102 may include the user first positioning the kayak 110 close to the installed location of the kayak storage tree 102 and close to the base plate 106 and central pole 108 of the kayak storage tree 102. The user may position the kayak 110 in a horizontal orientation at ground level 118. The user would then ensure that the top clip 128 is attached to one end of the cable 124 and then initially clip or fasten the top clip 128 onto the handle 130 or another portion of the kayak 110. The user may then begin pulling on the free end of the cable 124 (e.g., by grabbing onto either the bottom clip 128 attached to a lower end of the cable as shown in FIG. 4 or by grabbing onto another part of the cable 124) in order to cause the cable 124 to run through the pulley 120 until the kayak 110 is raised from a horizontal position to a fully vertical position. Then, the user may run the cable 124 around the kayak 110 and/or run the additional amount of cable 124 to connect to another kayak 110 (e.g. as shown at reference point 250 in FIG. 2) that has been raised to a vertical position, which can further tie down the kayaks 110 and minimize any movement of the kayaks 110 while stored in a vertically upright position against the central pole 108 of the storage tree. Finally, each kayak 110 is clipped and attached to an individual eye bolt 180*a*-180*d* via the bottom clip 128 that is secured and attached to a bottom end of the cable 124.

It is noted that in a non-limiting embodiment, the first hanging rod 144*a* and the second hanging rod 144*b* may be replaced with hooks similar to hook pieces 160*a* and/or 160*b*. Further, the hook pieces 160*a* and 160*b* may be replaced with rods similar to first hanging rod 144*a* and second hanging rod 144*b*. The hanging rods 144 and hook pieces 160 are examples of hanging mechanisms that may be used in a perpendicular arrangement as shown in FIGS. 1-3, for example, to hang between 1 to 4 kayaks on the kayak storage tree 102.

In other embodiments, other hanging mechanisms may be used in addition or as an alternative to hanging rods 144 and hook pieces 160, including but not limited to, hooks, anchors, wires, rods, nails and screws, hangers, and/or clips without limitation.

It is noted that the pulleys 120*a*, 120*b* may be part of an electric system and electrically capable of raising or lowering kayaks 110. Further, the kayak storage tree pole 108 may be made of plastic or metal or wood or other kinds of materials and combinations of materials in one or more non-limiting embodiments.

Figure 6:
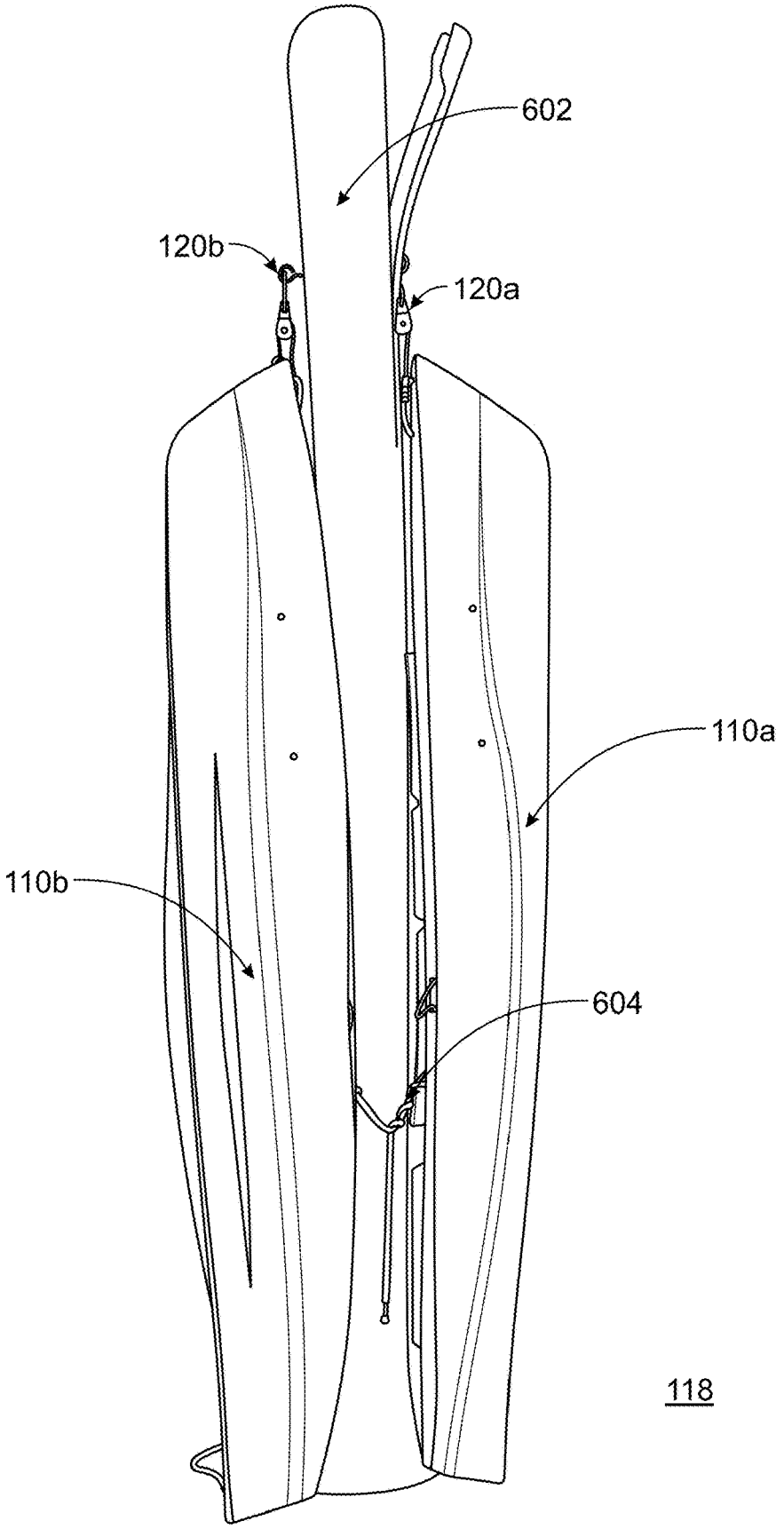
FIG. 6 is a pictorial illustration of another embodiment of a system and method to store kayaks.

FIG. 6 depicts a pictorial illustration of another embodiment and method and system for storing kayaks 110. In a non-limiting embodiment, an actual tree, such as tree 602 can be used to prop up and store one or more kayaks, such as kayaks 110*a*, 110*b* up against the sides of the tree 602. Any type of actual tree 602 may be used including one without a lot of limbs and/or leaves, or a tree that does have many limbs, branches, and leaves. A tree 602 may be defined as commonly defined which is a woody perennial plant, typically having a single stem or trunk growing to a considerable height and bearing lateral branches at some distance from the ground.

One or more bolts may be screwed into or otherwise attached to an upper portion of the tree 6602. Next, pulleys, such as pulley 120*a* and pulley 120*b*, may be hung or attached to the bolts and rope or other type of cable 604 may be fed through the pulleys 120*a*, 120*b*. The rope or cable 604 may be attached to the handle or other part of the kayks 110*a*, 110*b* and then the user can pull the rope or cable 604 that goes through the pulleys 120*a*, 120*b* to raise or lower the kayaks 110*a*, 110*b*. The intention is to raise the kayaks 110*a*, 110*b* from a horizontal position on the ground 118 near the tree 602 and to raise the kayaks 110*a*, 110*b* to a storable upright position against the sides of the tree 602. The user can also tie any extra rope or cable 604 together to help keep the kayaks 110*a*, 110*b* in an upright position.

Many other uses and advantages are provided by the kayak storage tree 102 as shown and as described herein.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "set" as used herein may refer to one or more items. Accordingly, "set" may mean a single item or more than one item.

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. An apparatus comprising:

a kayak storage tree for storing and holding one or more kayaks in an upright position when stored, further comprising:

a cover;

a central pole, wherein the central pole is attached to an underside of the cover;

a first hanging mechanism attached to a left side of the central pole, wherein the first hanging mechanism is attached to an upper portion of the central pole proximate to the underside of the cover, wherein a first pulley is attached to a terminal end of the first hanging mechanism, wherein a first cable is configured to be inserted into the first pulley;

a second hanging mechanism attached to a right side of the central pole, wherein the second hanging mechanism is attached to the upper portion of the central pole proximate to the underside of the cover, wherein a second pulley is attached to a terminal end of the second hanging mechanism, wherein a second cable is configured to be inserted into the second pulley;

a third hanging mechanism attached to a front side of the central pole, wherein the third hanging mechanism is generally perpendicular to the first hanging mechanism and the second hanging mechanism, wherein a third pulley is attached to the third hanging mechanism, wherein a third cable is configured to be inserted into the third pulley;

a fourth hanging mechanism attached to a rear side of the central pole, wherein the fourth hanging mechanism is generally perpendicular to the first hanging mechanism and the second hanging mechanism, wherein a fourth pulley is attached to the fourth hanging mechanism, wherein a fourth cable is configured to be inserted into the fourth pulley; and a base plate, wherein the central pole is also attached to a base plate.

2. The apparatus of claim 1, wherein the first hanging mechanism is a first hanging rod, and the second hanging mechanism is a second hanging rod.

3. The apparatus of claim 1, wherein the third hanging mechanism is a first hook piece and the fourth hanging mechanism is a second hook piece.

4. The apparatus of claim 1, wherein the base plate comprises a first anchor, a second anchor, a third anchor, and a fourth anchor.

5. The apparatus of claim 1, wherein the first anchor, the second anchor, the third anchor, and the fourth anchor are eye bolts.

6. The apparatus of claim 1, wherein the first anchor is attached to a front side of the base plate and the second anchor is attached to a rear side of the base plate.

7. The apparatus of claim 6, wherein the third anchor is attached to a left side of the base plate and the fourth anchor is attached to a right side of the base plate.

8. The apparatus of claim 1, wherein a width of the cover is wider than a width of the base plate.

9. The apparatus of claim 1, wherein the kayak storage tree is configured to store between one to four kayaks.

10. The apparatus of claim 1, wherein a kayak stored on the kayak storage tree is raised off of a ground level and stored in a vertical, upright position beneath the cover.

11. The apparatus of claim 1, wherein a clip fastener is attached to a first end of the first cable and wherein a second clip fastener is attached to a second end of the first cable, wherein the first cable is inserted through the first pulley.

12. The apparatus of claim 1, wherein a first clip fastener is attached to a first end of the second cable and wherein a second clip fastener is attached to a second end of the second cable, wherein the second cable is inserted through the second pulley.

13. The apparatus of claim 1, wherein a first clip fastener is attached to a first end of the third cable and wherein a second clip fastener is attached to a second end of the third cable, wherein the third cable is inserted through the third pulley.

14. The apparatus of claim 1, wherein a first clip fastener is attached to a first end of the fourth cable and wherein a second clip fastener is attached to a second end of the fourth cable, wherein the fourth cable is inserted through the fourth pulley.

* * * * *